US009243527B2

(12) United States Patent
Bidner

(10) Patent No.: US 9,243,527 B2
(45) Date of Patent: Jan. 26, 2016

(54) SYSTEM AND METHOD FOR REDUCING FRICTION IN ENGINES

(71) Applicant: Ford Global Technologies, LLC, Dearborn, MI (US)

(72) Inventor: David Karl Bidner, Livonia, MI (US)

(73) Assignee: Ford Global Technologies, LLC

( * ) Notice: Subject to any disclaimer, the term of this patent is extended or adjusted under 35 U.S.C. 154(b) by 0 days.

(21) Appl. No.: 14/014,197

(22) Filed: Aug. 29, 2013

(65) Prior Publication Data

US 2015/0059719 A1 Mar. 5, 2015

(51) Int. Cl.
*F02B 25/06* (2006.01)
*F01M 13/02* (2006.01)
*F02M 21/02* (2006.01)

(52) U.S. Cl.
CPC ..... *F01M 13/028* (2013.01); *F01M 13/02* (2013.01); *F01M 13/022* (2013.01); *F02M 21/0218* (2013.01)

(58) Field of Classification Search
CPC F02M 25/06; F02M 35/10222; F02M 25/089
USPC ..... 123/572–575, 41.86
See application file for complete search history.

(56) References Cited

U.S. PATENT DOCUMENTS 4,395,991 A * 8/1983 Miyachi ..... F02M 25/0836 123/519
6,729,316 B1 * 5/2004 Knowles ..... F01M 13/022 123/572
6,840,233 B2 * 1/2005 Lingenhult ..... F02M 25/0809 123/519
7,134,427 B2 * 11/2006 Colucci ..... C10M 129/40 123/274
7,712,456 B2 * 5/2010 Hirano ..... F01M 13/021 123/572
7,886,727 B2 * 2/2011 Ulrey et al. ..... 123/568.15
8,353,276 B2 * 1/2013 Lewis ..... F02M 25/06 123/572
8,360,038 B2 * 1/2013 Monros ..... 123/574
8,370,048 B2 * 2/2013 Monros ..... F01M 13/00 123/1 A
8,554,446 B2 * 10/2013 Sano et al. ..... 701/104
2011/0030658 A1 * 2/2011 Ulrey ..... F02M 25/089 123/521
2011/0197864 A1 * 8/2011 Karcher ..... F02M 25/089 123/574
2011/0313642 A1 * 12/2011 Sano ..... F02D 13/06 701/104
2011/0313652 A1 * 12/2011 Hancock ..... 701/201
2012/0048248 A1 * 3/2012 Valencia ..... F02M 35/10222 123/574
2012/0285421 A1 * 11/2012 Cunningham ..... B60T 17/02 123/436
2013/0237617 A1 9/2013 Menzel et al.
2013/0340732 A1 * 12/2013 Pursifull et al. . F02M 35/10222 123/572

OTHER PUBLICATIONS

Bidner, David Karl, "System and Method for Reducing Power Train Air Resistance," U.S. Appl. No. 13/895,192, filed May 15, 2013, 43 pages.

* cited by examiner

*Primary Examiner* — Lindsay Low
*Assistant Examiner* — Long T Tran
(74) *Attorney, Agent, or Firm* — Julia Voutyras; Alleman Hall McCoy Russell & Tuttle LLP

(57) ABSTRACT

A vehicle system comprises an internal combustion engine including a PCV system fluidly coupled to a gaseous fuel source via a flow control valve. The gaseous fuel source may be fluidly coupled to an air inflow line of the PCV system, and the flow control valve may be configured to control a flow of gaseous fuel into the PCV system.

19 Claims, 5 Drawing Sheets

SYSTEM AND METHOD FOR REDUCING FRICTION IN ENGINES

BACKGROUND AND SUMMARY

Internal combustion engines rely on high speed rotating machinery and gears that are rotating in ambient air. Resistance and friction from air surrounding the moving components of a vehicle's propulsion system contributes to fuel efficiency losses. Aerodynamic friction of the rotating and reciprocating components in the engine crankcase is conventionally mitigated with devices such as wind age trays, in order to reduce entrainment of oil droplets from the oil pan/sump into the air surrounding the engine's moving components. Entrained oil droplets further increases the drag forces acting on the engine components, thereby increasing engine load and decreasing fuel economy. Furthermore, in the power generation industry friction from air surrounding high speed electrical machinery is reduced by flooding the machinery with hydrogen gas, which has a lower viscosity than air.

The inventors have recognized certain issues with the above approaches. Namely, although wind age trays and similar devices reduce drag on engine components due to entrained oil, the drag forces due to the air surrounding the engine components is unaffected. Furthermore, hydrogen gas forms explosive mixtures with air in internal combustion engines.

One approach that at least partially addresses the above issues and that achieves the technical result of reducing friction in an internal combustion engine is to fill or partially fill the engine crankcase with a gaseous fuel such as methane. For example, the inventors have realized that by replacing air within the engine crankcase with a lower density gas, air resistance can be decreased while still providing sufficient engine cooling. Furthermore, methane gas viscosity is substantially lower than air and the flammability limits of methane in air are limited. Thus, in one embodiment, a vehicle system comprises a gaseous fuel source and an internal combustion engine including a positive crankcase ventilation (PCV) system, wherein the gaseous fuel source is fluidly coupled to the PCV system via a flow control valve, the flow control valve configured to control the flow of gaseous fuel into the PCV system. In another embodiment, a method comprises during a first condition, delivering gaseous fuel from a gaseous fuel source to the PCV system of an internal combustion engine, wherein the first condition comprises a calculated blow-by flow rate being less than a PCV valve flow rate. In a further embodiment, a vehicle may comprise a gaseous fuel source, an internal combustion engine including a PCV system, wherein the gaseous fuel source is fluidly coupled to the PCV system via a flow control valve, the flow control valve configured to control the flow of gaseous fuel into the PCV system, and a controller having executable instructions to during a first condition, deliver gaseous fuel from a gaseous fuel source to the PCV system of an internal combustion engine, wherein the first condition comprises a calculated blow-by flow rate being less than a PCV valve flow rate and a manifold vacuum being greater than a crankcase vacuum, wherein a flow rate of the gaseous fuel is calculated from a difference between a PCV valve flow rate and a blow-by gas flow rate, wherein the blow-by gas flow rate is calculated based on engine operating conditions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

In the propulsion system of a vehicle, power loss from air resistance is directly proportional to the density of the gas or fluid in which the component is rotating. Therefore, power losses from air resistance can be reduced by decreasing the density of the gas within the case surrounding the transmission, electric motor, or generator.

During rotation, an amount of heat is produced via mutual friction between the components. To prevent engine overheating, this heat may be removed from the components and displaced in another location. This is achieved when the components come into contact with cooler gasses that absorb heat from the system and transfer it into the atmosphere or cabin via a cooling system or vehicle movement during operation. Thus, though power losses are greatly diminished in an airless vacuum or low pressure case, cooling is decreased or eliminated leading to engine degradation. Therefore, air resistance mitigation may balance the power losses from air resistance with the desired cooling when determining pressure within transmission, motor, and generator cases.

The density and thus resistance within a rigid case (e.g. the engine crankcase) is a function of both the mass of gas within the case as well as the molecular properties of the gas contained. At standard temperature and pressure, ambient air has a density of approximately 1.2 $kg/m^3$ whereas methane has a density around 0.66 $kg/m^3$. Thus, the density of the gas and thus power loss from resistance may be decreased by replacing the ambient air within an engine positive crankcase ventilation (PCV) system or crankcase containing rotating parts with an amount of methane gas or and ambient air-methane gas mixture.

Compressed natural gas (CNG) engines may operate using a fuel source that contains an amount of methane for combustion. Therefore, in CNG engines, a supply of methane may be available for delivery to the engine PCV system without addition of an additional methane source. Further, in CNG engines, methane evacuated from an engine PCV system after absorbing an amount of heat in the engine crankcase may be cycled into the engine fuel line for combustion, minimizing fuel losses.

In an embodiment, the system disclosed herein may be used in a hybrid vehicle propulsion system with an electric generator/motor and a CNG engine. Other embodiments may have engine-only propulsion systems and/or may not operate on CNG. In non-CNG engine embodiments, CNG may be provided to the engine PCV system via a separate CNG source tank. In these embodiments, CNG may be delivered to an air intake of the engine PCV system for combustion or may be evacuated from the vehicle. Still further embodiments of non-CNG engines may have a closed CNG circuit for circulation of CNG through an engine PCV system and a cooling system. In engine-only propulsion systems, CNG may be provided to an engine PCV system.

Figure 1:
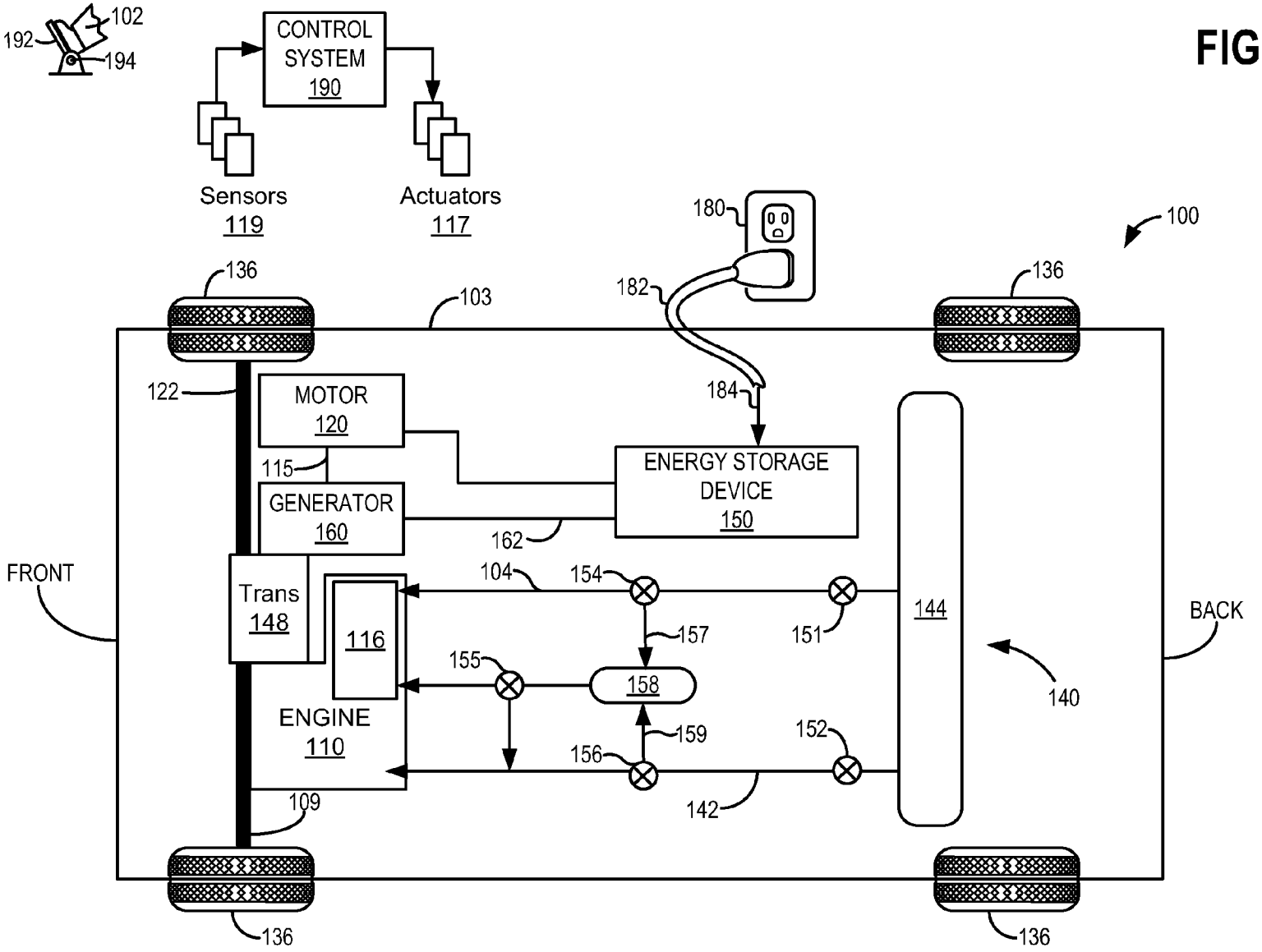
FIG. 1 schematically depicts an example embodiment of a vehicle system.

FIG. 1 schematically depicts an example vehicle system 100 as shown from a top view. Vehicle system 100 includes a vehicle body 103 with a front end, labeled "FRONT", and a back end labeled "BACK." Vehicle system 100 may include a plurality of wheels 136. For example, as shown in FIG. 1, vehicle system 100 may include a first pair of wheels adjacent to the front end of the vehicle and a second pair of wheels adjacent the back end of the vehicle.

Vehicle system 100 includes a fuel burning engine 110 and a motor 120. Engine 110 may comprise both an internal combustion engine 110 and an electric motor 120. Motor 120 may be configured to utilize or consume a different energy source than engine 110. For example, engine 110 may consume a liquid fuel (e.g. gasoline) or a gaseous fuel (e.g. natural gas, methane) to produce an engine output while motor 120 may consume electrical energy to produce a motor output. As such, a vehicle with propulsion system such as that shown in FIG. 1 may be referred to as a hybrid electric vehicle (HEV). However, in other embodiments, the vehicle system may comprise a non-hybrid vehicle.

Vehicle system 100 may operate in a variety of different modes in response to operator input and operating conditions. These modes may selectively activate, deactivate, or couple a propulsion system to the motor 120, generator 160, engine 110, or some combination thereof. For example, under select operating conditions, motor 120 may propel the vehicle via drive wheel 136 as indicated by line 122 while engine 110 is deactivated.

During alternate operating conditions, engine 110 may be set to a deactivated state (as described above) while motor 120 may be operated to charge energy storage device 150. For example, motor 120 may receive wheel torque from drive wheel 136 as indicated by line 122 where the generator 160 may convert the kinetic energy of the vehicle to electrical energy for storage at energy storage device 150 as indicated by line 162. This operation may be referred to as regenerative braking of the vehicle. The motor 120 and generator 160 may be a single entity such as a motor that has generation properties in some embodiments.

The engine 110 has rotational and reciprocating components that move within the engine crankcase. Traditionally the rotating and reciprocating components are in an air filled enclosure (e.g., crankcase) and thus experience efficiency losses from air resistance. Atmospheric air has a density near 1.22 kg/m$^3$ whereas methane has a density of 0.66 kg/m$^3$ and thus energy losses from resistance are lower in a methane filled enclosure. Thus, in an embodiment, gaseous fuel comprising compressed natural gas (CNG) or methane may be provided to a PCV system 116 of an engine 110 from the fuel tank 144. Methane may be provided to the PCV system 116 via fuel line 104 from fuel tank 144. Fuel tank 144 may also provide fuel directly for combustion in engine 110 via fuel line 142. In some embodiments, the engine crankcase may be sealed to prevent the escape of methane and may form a pressure vacuum.

A flow control valve 151, may control the flow rate of gaseous fuel into PCV system 116. The gaseous fuel flow rate may be controlled by a control system 190 via flow control valve 151 in response to input from one or more sensors 119, and/or based on engine operating conditions. As an example, sensors 119 may monitor temperature, pressure, and/or oxygen content within the engine 110. An additional sensor located downstream from valve 151 may monitor the gaseous fuel flow rate in fuel line 104. Valve 151 may also be responsive to pressure within line 104 so as to maintain a pressure for minimal atmospheric air leakage into the engine 110.

During still further operating conditions, engine 110 may be operated by combusting fuel received from fuel system 140 as indicated by fuel line 142. For example, engine 110 may be operated to propel the vehicle via drive wheel 136 as indicated by line 109 while motor 120 is deactivated. During other operating conditions, both engine 110 and motor 120 may each be operated to propel the vehicle via drive wheel 136 as indicated by lines 109 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels 136.

In other embodiments, the propulsion system of vehicle system 100 may be configured as a series type vehicle propulsion system, whereby the engine does not directly propel the drive wheels. Rather, engine 110 may be operated to power motor 120, which may in turn propel the vehicle via drive wheel 136 as indicated by line 122. For example, during select operating conditions, engine 110 may drive generator 160, which may in turn supply electrical energy to one or more of motor 120 as indicated by line 115 or energy storage device 150 as indicated by line 162.

As another example, engine 110 may be operated to drive motor 120 which may in turn provide a generator function to convert the engine output to electrical energy, where the electrical energy may be stored in energy storage device 150 for later use by the motor. Embodiments of energy storage device 150 may include one or more rechargeable batteries, fuel cells, and/or capacitors for example. In these examples, electrical energy may be temporarily converted to chemical or potential energy for storage. The vehicle propulsion system may be configured to transition between two or more of the operating modes described above in response to operating conditions.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc.

Fuel system 140 may include one or more fuel storage tanks 144 for storing fuel on-board the vehicle. For example, fuel tank 144 may store a condensed natural gas (CNG) fuel source, such as methane gas. Other embodiments may have a first gaseous fuel source stored in fuel tank 144 and a second liquid fuel source stored in an additional fuel tank. In these embodiments the gaseous fuel source may be coupled to engine 110 and the liquid fuel source may be coupled to engine 110. In some examples, the fuel may be stored on-board the vehicle as a blend of two or more different fuels. A liquid fuel source may be configured to store a blend of gasoline and ethanol (e.g. E10, E85, etc.) or a blend of gasoline and methanol (e.g. M10, M85, etc.). A gaseous fuel source may be a blend of methane, hydrogen gas, oxygen gas, or carbon monoxide. Fuels or fuel blends may be delivered to engine 110 as indicated by fuel line 142. Still other suitable fuels or fuel blends may be supplied to engine 110, where they may be combusted at the engine to produce an engine output. The engine output may be utilized to propel the vehicle as indicated by line 109 or to recharge energy storage device 150 via motor 120 or generator 160.

Gaseous fuel from fuel line 104 and fuel line 142 may also be directed via three-way valves 154 and 156, respectively to a purge canister 158. As an example, purge canister 158 may be filled with an appropriate adsorbent for temporarily trapping fuel vapors (including vaporized hydrocarbons). In one example, the adsorbent used is activated charcoal. During vehicle operation, for example, when delivery of gaseous fuel to the PCV system 116 and/or engine 110 is stopped, gaseous fuel in fuel line 104 and/or fuel line 142, respectively, may be directed to the purge canister 158 for storage. Delivery of gaseous fuel to the engine 110 may be stopped when the engine is turned off, or during deceleration fuel shut-off (DFSO), as examples. By directing gaseous fuel remaining in fuel lines 104 and 142 to the purge canister 158 when delivery of gaseous fuel to the PCV system 116 and engine 110 is stopped, emission of fuel vapors to the atmosphere can be reduced. Control system 190 may actuate three-way valves 154 and 156 to direct gaseous fuel to the purge canister 158.

Three-way valve 155 may be responsive to operating conditions and may couple purge canister 158 to fuel line 142 or to PCV system 116. As an example, gaseous fuel may be delivered to fuel line 142 for engine combustion or to PCV system 116 via three-way valve 155 when sufficient pressure in the purge canister is available. For example, if the pressure in the purge canister 158 is greater than the pressure in the PCV system, three-way valve may fluidly couple purge canister 158 to PCV system 116. When gaseous fuel is not being delivered to the PCV system 116 three-way valve 155 may couple purge canister 158 to the fuel line 142. Thus when the engine is not operating fuel may be stored in purge canister 158 for subsequent combustion when the engine is operating. Purge canister 158 may provide a pressure differential to accelerate fuel into the fuel lines 104 and 142. Three-way valve 155 may therefore be responsive to the pressure available in purge canister 158, if sufficient pressure is not available to accelerate fuel from purge canister 158 to fuel lines 104 and/or 142, valve 155 may close so that gaseous fuel may be stored in purge canister 158 until sufficient pressure is accumulated in the canister. Three-way valve 155 may be controlled by control system 190.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, transmission 148, and generator 160. Further, control system 190 may send control signals to one or more of engine 110, motor 120, fuel system 140, energy storage device 150, and generator 160 responsive to this sensory feedback. Control system 190 may receive an indication of an operator 132 requested output of the vehicle propulsion system from a vehicle operator 132. For example, control system 190 may receive sensory feedback from pedal position (PP) sensor 134 which communicates with pedal 130. Pedal 130 may refer schematically to a brake pedal and/or an accelerator pedal.

Energy storage device 150 may periodically receive electrical energy from a power source 180 residing external to the vehicle (e.g. not part of the vehicle) as indicated by line 184. As a non-limiting example, the propulsion system of vehicle system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, the propulsion system of vehicle system 100 may be refueled by receiving fuel via a fuel dispensing device (not shown). In some embodiments, fuel tank 144 may be configured to store the fuel received from fuel dispensing device until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication lamp.

This plug-in hybrid electric vehicle, as described with reference to the propulsion system of vehicle system 100, may be configured to utilize a secondary form of energy (e.g. electrical energy) that is periodically received from an energy source that is not otherwise part of the vehicle.

It should be understood that though FIG. 1 shows a plug-in hybrid electric vehicle, in other examples, vehicle system 100 may be a hybrid vehicle system without plug-in components. Further, in other examples, vehicle system 100 may not be a hybrid vehicle but may be another type of vehicle with other propulsion mechanisms, e.g., a vehicle with a gasoline engine or a CNG engine which may or may not include other propulsion systems.

Figure 2:
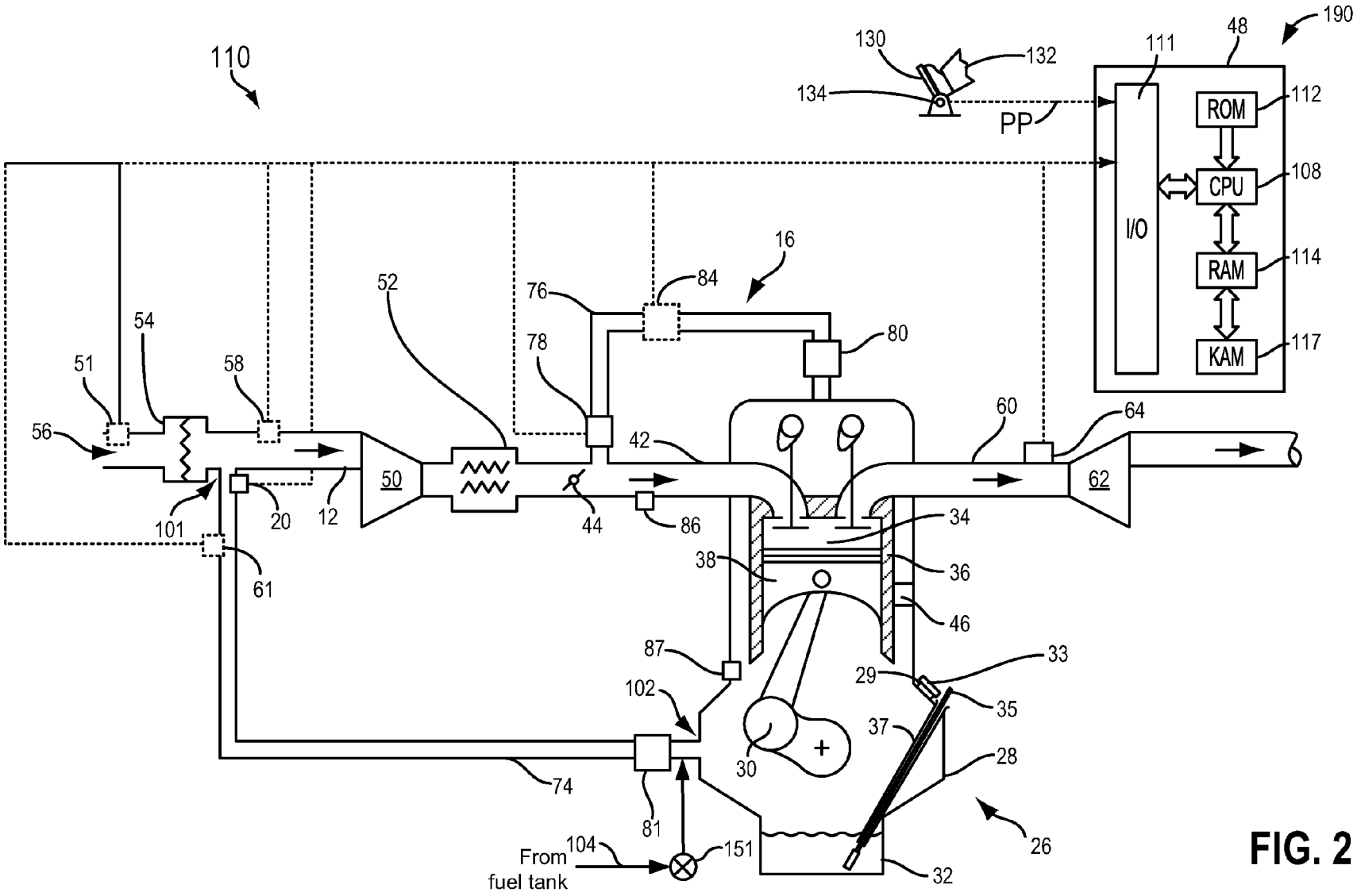
FIG. 2 illustrates an example of an engine with a positive crankcase ventilation (PCV) system.

Referring now to FIG. 2, it shows an example configuration of a multi-cylinder engine generally depicted at 110, which may be included in a propulsion system of an automobile. Engine 110 may be controlled at least partially by a control system 190 of the vehicle including controller 48 and by input from a vehicle operator 132 via an input device 130. In this example, input device 130 includes an accelerator pedal and a pedal position sensor 134 for generating a proportional pedal position signal PP.

Engine 110 may include a lower portion of the engine block, indicated generally at 26, which may include a crankcase 28 encasing a crankshaft 30. Crankcase 28 contains gas and may include an oil sump 32, otherwise referred to as an oil well, holding engine lubricant (e.g., oil) positioned below the crankshaft 30. An oil fill port 29 may be disposed in crankcase 28 so that oil may be supplied to oil sump 32. Oil fill port 29 may include an oil cap 33 to seal oil port 29 when the engine is in operation. A dip stick tube 37 may also be disposed in crankcase 28 and may include a dipstick 35 for measuring a level of oil in oil sump 32. In addition, crankcase 28 may include a plurality of other orifices for servicing components in crankcase 28. These orifices in crankcase 28 may be maintained closed during engine operation so that a crankcase ventilation system (described below) may operate during engine operation.

The upper portion of engine block 26 may include a combustion chamber (e.g., cylinder) 34. The combustion chamber 34 may include combustion chamber walls 36 with piston 38 positioned therein. Piston 38 may be coupled to crankshaft 30 so that reciprocating motion of the piston is translated into rotational motion of the crankshaft. Combustion chamber 34 may receive fuel from fuel injectors (not shown) and intake air from intake manifold 42 which is positioned downstream of throttle 44. The engine block 26 may also include an engine coolant temperature (ECT) sensor 46 input into a controller 48 (described in more detail below herein).

A throttle 44 may be disposed in the engine intake to control the airflow entering intake manifold 42 and may be preceded upstream by compressor 50 followed by charge air cooler 52, for example. Compressor 50 may compress the intake air to engine 110, thereby boosting intake air pressure and density providing boosted engine conditions (e.g., manifold air pressure>barometric pressure), for example during increased engine loads. An air filter 54 may be positioned upstream compressor 50 and may filter fresh air entering intake passage 56.

Exhaust combustion gases exit the combustion chamber 34 via exhaust passage 60 located upstream of turbine 62. An exhaust gas sensor 64 may be disposed along exhaust passage 60 upstream of turbine 62. Turbine 62 may be equipped with a wastegate bypassing it, and turbine 62 may be driven by the flow of exhaust gases passing therethrough. Furthermore, turbine 62 may be mechanically coupled to compressor 50 via a common shaft (not shown), such that rotation of turbine 62 may drive compressor 50. Sensor 64 may be a suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Exhaust gas sensor 64 may be connected with controller 48.

In the example of FIG. 2, a positive crankcase ventilation system (PCV) 116 is coupled to the engine fresh air intake 12 so that gases in the crankcase 28 may be vented in a controlled manner. During normal engine operation, gases in the combustion chamber 34 may escape past the piston. These blow-by gases may include unburned fuel, combustion products, and air. Blow-by gases can dilute and contaminate oil, causing corrosion to engine components and contributing to sludge build-up, reducing the protective and lubricating properties of the oil. At higher engine speeds, blow-by gases can increase crankcase pressure such that oil leakage may occur from sealed engine surfaces. The PCV system 116 may help to vent and remove blow-by gases from the engine crankcase in a controlled manner in order to mitigate these harmful effects of blow-by gases and may combine them with an engine intake stream so that they may be combusted within the engine. By redirecting blow-by gases to the engine intake, the PCV system 116 further aids in reducing engine emissions by precluding venting of blow-by gases to the atmosphere.

The PCV system 116 includes a PCV valve 78 fluidly coupled to an engine crankcase 28. As an example, the PCV valve 78 may be coupled to a valve cover in the engine, which may allow for the PCV system to draw blow-by gases from the engine while reducing the entrainment of oil from the crankcase. The PCV valve 78 may also be fluidly coupled to the engine intake manifold 42. The PCV valve gas flow rate may vary with engine conditions such as engine speed and load, and the PCV valve 78 may be calibrated for a particular engine application wherein the PCV valve gas flow rate may be adjusted as operating conditions change. As an example, when the engine is off, the PCV valve may be closed and no gases may flow through the PCV valve 78. When the engine speed is idling or low, or during deceleration when the intake manifold vacuum is relatively high, the PCV valve 78 may open slightly, allowing for restricted PCV valve gas flow rates. At engine speeds or loads higher than idling, intake manifold vacuum may lower, and the PCV valve 78 may allow for higher PCV valve gas flow rates. PCV valve 78 may include a conventional PCV valve or a push-pull type PCV valve.

During non-boosted conditions (when intake manifold pressure (MAP) is less than barometric pressure (BP)), the PCV system 116 draws air into crankcase 28 via a breather or crankcase ventilation (vent) tube 74. A first end 101 of crankcase ventilation tube 74 may be mechanically coupled, or connected, to fresh air intake 12 upstream of compressor 50. In some examples, the first end 101 of crankcase ventilation tube 74 may be coupled to fresh air intake 12 downstream of air filter 54 (as shown). In other examples, the crankcase ventilation tube may be coupled to fresh air intake 12 upstream of air filter 54. In yet another example, the crankcase ventilation tube may be coupled to air filter 54. A second end 102, opposite first end 101, of crankcase ventilation tube 74 may be mechanically coupled, or connected, to crankcase 28 via an oil separator 81.

In some embodiments, crankcase ventilation tube 74 may include a pressure sensor 61 coupled therein. Pressure sensor 61 may be an absolute pressure sensor or a gauge sensor. One or more additional pressure and/or flow sensors may be coupled to the PCV system 116 at alternate locations. For example, a barometric pressure sensor (BP sensor) 51 may be coupled to intake passage 56, upstream of air filter 54, for providing an estimate of barometric pressure (BP). In one example, where pressure sensor 61 is configured as a gauge sensor, BP sensor 51 may be used in conjunction with pressure sensor 61. In some embodiments, a compressor inlet pressure (CIP) sensor 58 may be coupled in intake passage 56 downstream of air filter 54 and upstream of compressor 50 to provide an estimate of the compressor inlet pressure (CIP).

During non-boosted conditions, the PCV system 116 vents air out of the crankcase and into intake manifold 42 via conduit 76 which, in some examples, may include a one-way PCV valve 78 to provide continual evacuation of gases from inside the crankcase 28 before connecting to the intake manifold 42. In one embodiment, the PCV valve 78 may vary its flow restriction in response to the pressure drop across it (or flow rate through it). However, in other examples conduit 76 may not include a one-way PCV valve. In still other examples, the PCV valve may be an electronically controlled valve that is controlled by controller 48. It will be appreciated that, as used herein, PCV flow refers to the flow of gases through conduit 76 from the crankcase to the intake manifold 42. As an example, the PCV flow may be determined from the fuel (e.g., gaseous fuel) injection rate, the air/fuel ratio in the engine intake, and the exhaust oxygen content via exhaust gas sensor 64, using known methods.

As used herein, PCV backflow refers to the flow of gases through conduit 76 from the intake manifold 42 to the crankcase 28. PCV backflow may occur when intake manifold pressure is higher than crankcase pressure (e.g., during boosted engine operation). In some examples, PCV system 116 may be equipped with a check valve for preventing PCV backflow. It will be appreciated that while the depicted example shows PCV valve 78 as a passive valve, this is not meant to be limiting, and in alternate embodiments, PCV valve 78 may be an electronically controlled valve (e.g., a powertrain control module (PCM) controlled valve) wherein a controller 48 of control system 190 may command a signal to change a position of the valve from an open position (or a position of high flow) to a closed position (or a position of low flow), or vice versa, or any position there-between.

During boosted conditions (when MAP is greater than BP), gases flow from the crankcase, through oil separator 81 and into fresh air intake 12 and eventually into the combustion chamber 34. This may be done in a stale air manner where no intake manifold air is let into the crankcase 28 or in a positive crankcase ventilation manner where some manifold air is metered into the crankcase 28.

While the engine is running under light load and moderate throttle opening, the intake manifold air pressure may be less than crankcase air pressure. The lower pressure of the intake manifold 42 draws fresh air towards it, pulling air from the crankcase ventilation tube 74 through the crankcase (where it dilutes and mixes with combustion gases), out of the crankcase via the PCV conduit 76 through the PCV valve 78, and into the intake manifold 42. However, during other conditions, such as heavy load or under boosted conditions, the intake manifold air pressure may be greater than crankcase air pressure. As such, intake air may travel through the PCV conduit 76 and into the crankcase 28.

The gases in crankcase 28 may include un-burned fuel, un-combusted air, and fully or partially combusted gases. Further, lubricant mist may also be present. As such, various oil separators may be incorporated in positive PCV system 116 to reduce exiting of the oil mist from the crankcase 28 through the PCV system 116. For example, conduit 76 may include a uni-directional oil separator 80 which filters oil from vapors exiting crankcase 28 before they re-enter the intake manifold 42. Another oil separator 81 may be disposed in crankcase ventilation tube 74 to remove oil from the stream of gases exiting the crankcases during boosted operation. Additionally, in some embodiments, conduit 76 may also include a vacuum sensor 84 coupled to the PCV system 116.

Controller 48 is shown in FIG. 2 as a microcomputer, including microprocessor unit 108, input/output device 111, an electronic storage medium for executable programs and calibration values shown as read only memory chip 112 in this particular example, random access memory 114, keep alive memory 117, and a data bus. Controller 48 may receive various signals from various sensors 119 coupled to engine 110, engine coolant temperature (ECT) from temperature sensor 46; a measurement of intake manifold pressure (MAP) from pressure sensor 86; a measurement of crankcase pressure from pressure sensor 87, a measurement of barometric pressure from BP sensor 51; exhaust gas air/fuel ratio from exhaust gas sensor 64; and other PCV diagnostic sensors described below. Storage medium read-only memory 112 can be programmed with computer readable data representing instructions executable by processor 108 for performing the methods described below, as well as other variants that are anticipated but not specifically listed.

Under certain conditions, the PCV system 116 may be monitored by a variety of sensors in the PCV system 116. In some embodiments, a plurality of absolute sensors, e.g., a barometric pressure sensor (BP) 51, a compressor inlet pressure sensor (CIP) 58, and/or a pressure sensor 61 in the crankcase ventilation tube 74, may be used in combination to monitor PCV system pressure. For example, in some approaches, a barometric pressure sensor 51, a compressor inlet sensor 58, and a pressure sensor 61 in the PCV breather tube 74 may all be used in to monitor PCV system pressure.

In an alternate embodiment, MAP and compressor inlet pressure (CIP) and/or MAP and crankcase pressure may be used instead of MAP and BP to determine when the engine is boosted or not boosted. For example, when MAP is less than CIP, the engine may not be boosted. In another example, when MAP is greater than CIP or crankcase pressure, the engine may be boosted.

As described above for FIG. 1, gaseous fuel such as methane may be delivered to PCV system 116 from fuel tank 144 via gaseous fuel flow control valve 151 in fuel line 104. As shown in the example of FIG. 2, the gaseous fuel may be delivered to an air inflow line, such as crankcase ventilation tube 74, of PCV system 116. Delivering gaseous fuel such as methane to the PCV system and the crankcase containing rotating components may decrease the amount of air within the case and replace it with lower density gas. The lower density gas may result in reduced friction and resistance experienced by moving components, cooler operation, and greater efficiency. For example, the density and viscosity of methane gas is lower than air, and thus partially or completely replacing air by methane gas aids in lowering engine friction due to air resistance while maintaining engine cooling.

Furthermore, ignition of fuel may cause degradation of engine components. Because methane is flammable within a limited air/fuel ratio window (e.g., 5-15% methane in air), methane provides a broader range of air/fuel ratios for engine operation as compared to other lower density fuels such as hydrogen. The flammability threshold may also be responsive to the pressure such that the desired pressure may be a function of the air/fuel ratio from methane injection as well as the pressure within the system that is achieved by the increased amount of methane injection.

In this manner, a vehicle system may comprise an internal combustion engine including a PCV system fluidly coupled to a gaseous fuel source via a flow control valve. The gaseous fuel source may be fluidly coupled to an air inflow line of the PCV system, and the flow control valve may be configured to control a flow of gaseous fuel into the PCV system. Furthermore, the vehicle system may further comprise a purge canister fluidly coupled to the PCV system, wherein the purge canister is fluidly coupled to a fuel line. Further still, the gaseous fuel source may comprise methane, and a gaseous fuel viscosity may be lower than a viscosity of air.

In this manner, a vehicle may comprise an internal combustion engine including a PCV system fluidly coupled to a gaseous fuel source via a flow control valve, and a controller having executable instructions to deliver gaseous fuel from a gaseous fuel source to the PCV system of an internal combustion engine responsive to a blow-by flow rate being less than a PCV valve flow rate and a manifold vacuum being greater than a crankcase vacuum. The gaseous fuel source may be fluidly coupled to an air inlet line of the PCV system or directly to the crankcase, and the flow control valve may be configured to deliver the gaseous fuel at a gaseous fuel flow rate of a difference between the PCV valve flow rate and the blow-by gas flow rate. Furthermore, the executable instructions may further comprise closing the flow control valve in response to the manifold vacuum dropping below a crankcase vacuum.

Figure 3:
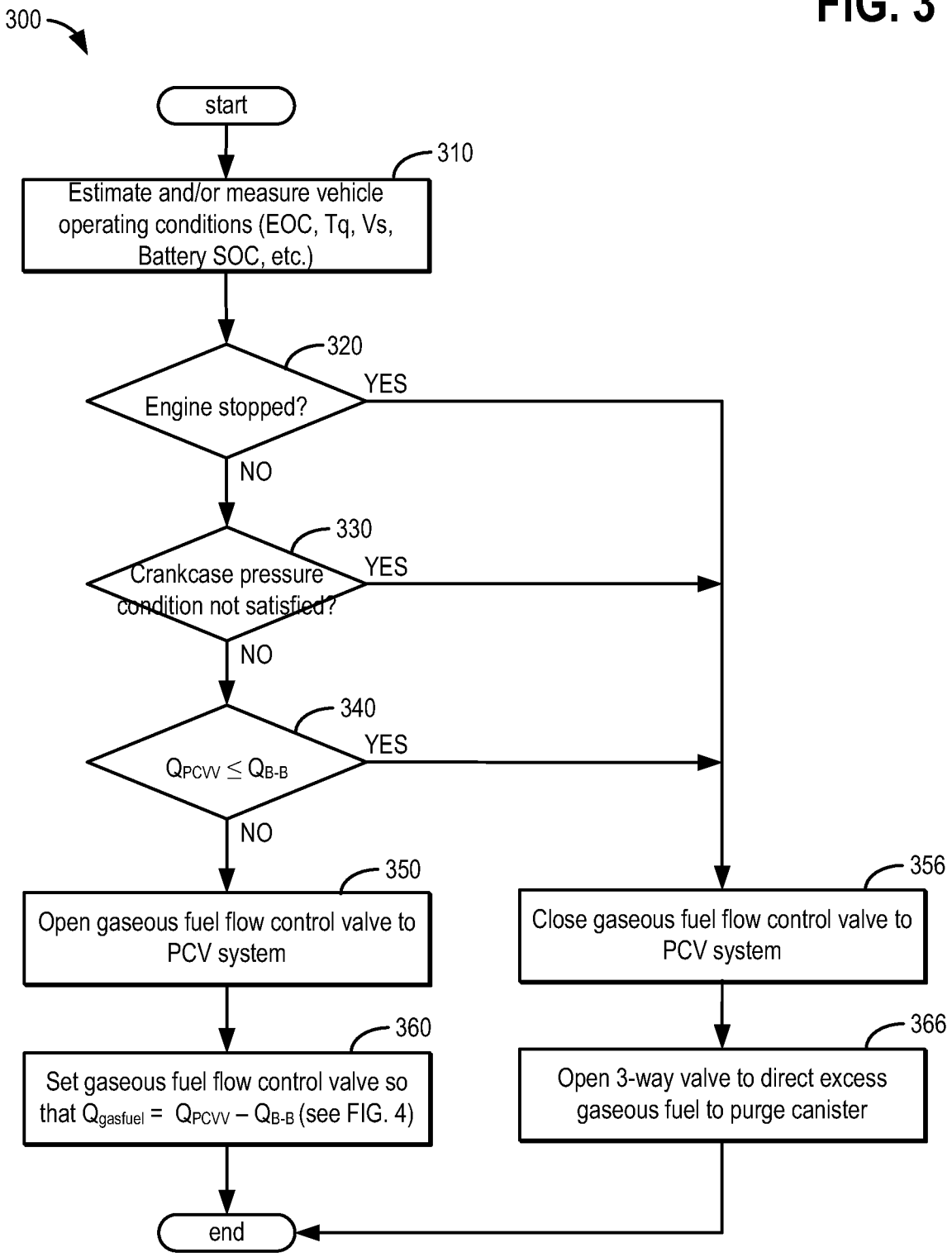
FIGS. 3-4 illustrate example operating methods for a vehicle system.

Turning now to FIG. 3, it shows a high-level routine 300 for operating the propulsion system of a vehicle, such as propulsion system of vehicle system 100 shown in FIG. 1. Routine 300 may be performed at engine on, for example by control system 190, and may subsequently be performed repeatedly to provide a determination of the operating mode of the propulsion system.

Routine 300 may begin at 310 where the vehicle operating conditions such as engine on condition (EOC), torque (Tq), vehicle speed (Vs), battery state of charge (SOC), and the like are determined. Routine 300 continues at 320 where it is determined if the engine is stopped. For example, the engine may be stopped in a hybrid vehicle when a vehicle speed is below a threshold vehicle speed, such as during high traffic conditions or when the vehicle is stopped or parked.

If the engine is running at 320, then routine 300 continues at 330 where it is determined if a crankcase pressure condition is satisfied. In one example, the crankcase pressure condition may be satisfied if the manifold vacuum is greater than the vacuum in the crankcase. If the intake manifold vacuum is less than a crankcase vacuum, then PCV blow-by and gaseous fuel directed to the crankcase or the crankcase inlet may not be conveyed to the engine intake. Intake manifold vacuum may be measured by a pressure sensor positioned at or near the intake manifold, such as vacuum sensor 84 in PCV conduit and/or by intake pressure sensor 86. Furthermore, crankcase pressure or crankcase vacuum may be measured by a pressure or vacuum sensor positioned at the crankcase, such as pressure sensor 87.

When the intake manifold vacuum is less than the crankcase vacuum, delivery of gaseous fuel to the engine crankcase 28 may not be reliably controlled, as compared to when the intake manifold vacuum is greater than the crankcase vacuum. For example, when the intake manifold vacuum is less than a crankcase vacuum, the manifold vacuum may not be high enough to pull gaseous fuel and PCV gases into the engine crankcase. Accordingly, if the intake manifold vacuum is less than the crankcase vacuum (e.g., intake manifold pressure is greater than crankcase pressure), the crankcase pressure condition is not satisfied.

In another example, the crankcase pressure condition may be satisfied if the crankcase pressure is less than an upper threshold crankcase pressure. If the crankcase pressure is above an upper threshold crankcase pressure, delivering gaseous fuel to the crankcase may over pressurize the oil pan and valve cover oil gaskets. Accordingly, if the crankcase pressure is above the upper threshold crankcase pressure, then the crankcase pressure condition is not satisfied. The upper threshold crankcase pressure may be a predetermined based on the crankcase design, engine operating conditions, oil gaskets, and the like.

If the crankcase pressure condition is satisfied at 330, routine 300 continues at 340 where it determines if a PCV valve flow rate ($Q_{PCVV}$) is less than or equal to a blow-by flow rate ($Q_{B\text{-}B}$). $Q_{PCVV}$ may be determined from engine operating conditions such as a fuel injection rate, an intake air/fuel ratio, and an exhaust gas oxygen sensor. For example, the exhaust gas oxygen sensor may indicate the rate of fuel and air combusted in the engine, and the flow rate of fuel and air delivered to the engine may be provided by the fuel injection rate and the intake air/fuel ratio. Thus, in one example, $Q_{PCVV}$ may be inferred from a difference between the flow rate of fuel and air delivered to the engine and the rate of fuel and air combusted in the engine. $Q_{B\text{-}B}$ may be a calculated flow rate based on engine design, engine wear, and engine operating conditions such as engine speed, load, and the like. For example, $Q_{B\text{-}B}$ may be larger for engines with appreciable wear as compared to a newer engine, and $Q_{B\text{-}B}$ may increase when engine speed and load are increased. Calculation of $Q_{B\text{-}B}$, and determining $Q_{PCVV}$ may be performed by control system 190.

If $Q_{PCVV}$ is greater than $Q_{B\text{-}B}$ at 340, then routine 300 continues at 350 where the gaseous fuel flow control valve 151 to the PCV system 116 is opened to direct gaseous fuel, for example methane, to the PCV system 116. As illustrated in FIG. 2, gaseous fuel may be directed to the PCV system 116 via gaseous fuel flow control valve 151 and fuel line 104. In one example, the gaseous fuel from fuel line 104 may be directed to an air inflow line such as crankcase ventilation tube 74 of PCV system 116. In another example, the gaseous fuel from fuel line 104 may be directed to the crankcase 28 of PCV system 116. For example, at higher engine loads and higher engine speeds when blow-by gas flow is higher as compared to lower engine loads and lower engine speeds, blow-by gas flow may flow out of crankcase 28 via conduit 76 and via crankcase ventilation tube 74. Accordingly, injecting gaseous fuel from fuel line 104 at crankcase 28 (or at crankcase ventilation tube 74 at a location very close to crankcase 28) enables the gaseous fuel to reach the crankcase for increasing engine component lubrication and reducing friction before being blow out into the air intake system for combustion.

Figure 4:
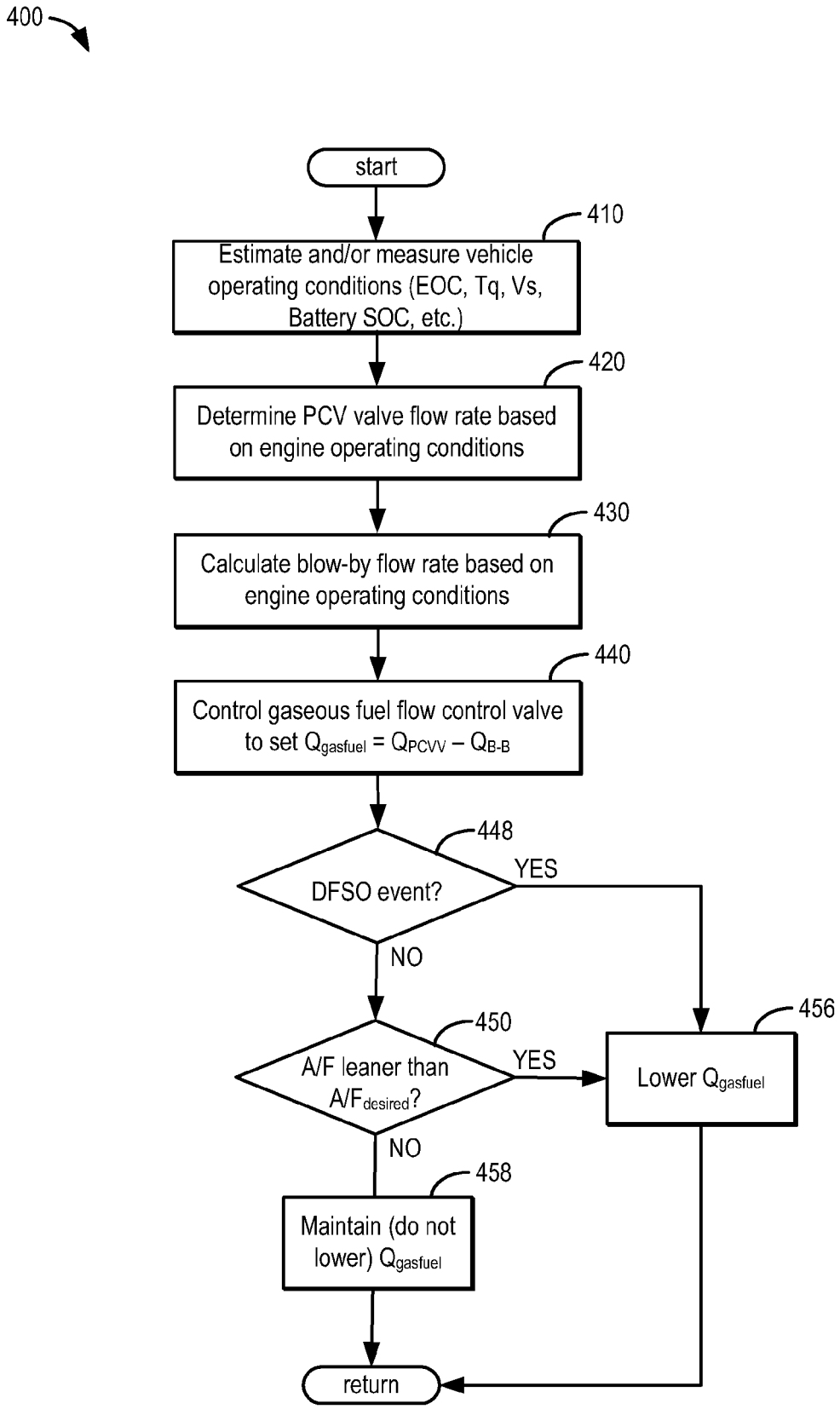

Next, routine 300 continues at 360, where the gaseous fuel flow rate is controlled by control system 190 by setting the gaseous fuel flow control valve 151 so that $Q_{gasfuel}=Q_{PCVV}-Q_{B\text{-}B}$. FIG. 4 illustrates an example routine 400 for a vehicle system 100 for controlling the gaseous fuel flow rate to the PCV system 116. Routine 400 begins at 410 where the vehicle operating conditions such as engine on condition (EOC), torque (Tq), vehicle speed (Vs), battery state of charge (SOC), and the like are estimated and/or measured. Routine 400 continues at 420 where $Q_{PCVV}$ is determined. In one example, as described above, $Q_{PCVV}$ may be determined based on a fuel injection rate, an intake air/fuel ratio, and an exhaust gas oxygen sensor. In addition, $Q_{PCVV}$ may be determined using additional engine operating conditions.

Routine 400 continues at 430 where $Q_{B\text{-}B}$ is calculated. As described above, $Q_{B\text{-}B}$ may be a calculated flow rate based on engine design, engine wear, and engine operating conditions such as engine speed, load, and the like. In another example, $Q_{B\text{-}B}$ may be calculated from a predetermined model residing in control system 190 using a combination of engine operating conditions.

Next, routine 400 continues at 440, where the gaseous fuel flow control valve is set by controller 48 such that $Q_{gasfuel}=Q_{PCVV}-Q_{B\text{-}B}$. Accordingly, controller 48 may open or close gaseous fuel flow control valve 151 partially or fully in order to deliver gaseous fuel such as methane to the PCV system 116 to makeup the PCV valve flow rate minus the blow-by gas flow rate. After 440, routine 400 continues at 448 where it determines if a DFSO event has just occurred. If a DFSO event has just occurred, routine 400 continues at 456. If a DFSO event has not occurred, routine 400 continues at 450.

At 450, routine determines if the air/fuel ratio, A/F, is leaner than a desired air/fuel ratio, $A/F_{desired}$. $A/F_{desired}$ may be based on engine operating conditions such as engine speed and load, fuel injection rate, purge flow from a purge canister, found fuel (outgassing of fuel from the oil), gaseous fuel flow to the PCV system, recirculated blow-by gases, and the like in order to maintain fuel economy and to reduce emissions. Estimating and controlling the gaseous fuel flow to the PCV system may aid in estimating and controlling A/F. For example, characterization of the pulse width and pressure drop of a solenoid gaseous fuel flow control valve 151 may aid in estimating the contribution of gaseous fuel flow to the PCV system to A/F. A/F may be measured using intake and/or exhaust gas oxygen sensors. In one example, if the calculated $Q_{B\text{-}B}$ is lower than the actual blow-by gas flow rate A/F may be leaner than $A/F_{desired}$ and $Q_{gasfuel}$ is greater than $Q_{PCVV}-Q_{B\text{-}B,actual}$. The higher $Q_{gasfuel}$ in this example may result in A/F being leaner than $A/F_{desired}$. From 450, the routine continues to 458 to maintain, (not lower), $Q_{gasfuel}$, for example independent of the values of $A/F-A/F_{desired}$ and $Q_{PCVV}-Q_{B\text{-}B}$.

If A/F is leaner than $A/F_{desired}$, or if a DFSO event has just occurred, routine 400 continues at 456 from 450, where $Q_{gasfuel}$ is lowered. The amount that $Q_{gasfuel}$ is lowered at 450 may depend on the difference between A/F and $A/F_{desired}$ and $Q_{PCVV}-Q_{B-B}$. For example, $Q_{gasfuel}$ may be lowered by an amount proportional to $A/F-A/F_{desired}$ and proportional to $Q_{PCVV}-Q_{B-B}$. Other methods of lowering $Q_{gasfuel}$ may be used, including stopping $Q_{gasfuel}$. Stopping $Q_{gasfuel}$ after a DFSO event may aid in decelerating the vehicle since gaseous fuel would no longer provide lubrication and reduction of friction of the engine components, and friction in the engine may increase. As a further example, $Q_{gasfuel}$ may be turned off prior to an upcoming DFSO event, during the period in which the engine is performing torque management in anticipation of the DFSO event, which may allow for more prompt purging or burning of the remaining gaseous fuel in the crankcase. In carrying out routine 400, control system 190 may achieve a gas fuel flow rate to the PCV system 116 to maintain A/F at $A/F_{desired}$ and to set $Q_{gasfuel}=Q_{PCVV}-Q_{B-B}$. If A/F is not leaner than $A/F_{desired}$ at 450 or after 456, routine 400 returns to routine 300 at 360. Returning to routine 300 at 360, after 360, routine 300 ends. Alternately, if routine 400 determines that a DFSO event has just occurred, $Q_{gasfuel}$ may be lowered according to an excess amount of gaseous fuel delivered to the PCV system 116, for example, at the crankcase ventilation tube 74. After a DFSO event has occurred, the excess amount of gaseous fuel delivered to the PCV system 116 may be proportional to $Q_{PCVV}-Q_{B-B}$.

Returning to 320, 330 and 340 of routine 300, if the engine is stopped at 320, if the crankcase pressure condition is not satisfied at 330, or if $Q_{PCVV}\leq Q_{B-B}$ at 340, then routine 300 continues at 356. At 356, routine 300 closes the gaseous fuel flow control valve 151 to stop delivery of gaseous fuel to the PCV system 116. Next, routine 300 continues at 366, where it may open three-way valve 154 to direct gaseous fuel in fuel line 104 to purge canister 158 for storage. Gaseous fuel stored in purge canister 158 may be directed to engine 110 for combustion via three-way valve 155 or to PCV system 116 depending on vehicle operating conditions. For example, if a purge canister pressure is greater than a PCV system pressure, then gaseous fuel stored in purge canister 158 may be directed to the PCV system 116 via three-way valve 155 by control system 190. Purge canister pressure may include a pressure sensor thereat for determining purge canister pressure and for communicating said purge canister pressure to control system 190. PCV system pressure may be indicated for example, by pressure sensor 86 or by a pressure sensor mounted in the PCV system 116 such as at crankcase 28, or in crankcase ventilation tube 74. After 366, routine 300 ends.

In this manner, a method may comprise delivering a gaseous fuel from a gaseous fuel source to a PCV system of an engine in response to a blow-by flow rate being less than a PCV valve flow rate. The method may further comprise initiating the delivery of gaseous fuel from the gaseous fuel source to the PCV system in response to the blow-by gas flow rate falling below the PCV valve flow rate only while a manifold vacuum is greater than a crankcase vacuum, the crankcase vacuum increasing with an increasing engine speed. The gaseous fuel may be delivered at a flow rate of a difference between the PCV valve flow rate and the blow-by gas flow rate. The method may further comprise stopping the delivery of gaseous fuel from the gaseous fuel source to the PCV system when the engine is stopped, and the method may further comprise stopping the delivery of gaseous fuel from the gaseous fuel source to the PCV system when the manifold vacuum is below a crankcase vacuum. Further still, the method may comprise lowering the flow rate of the gaseous fuel in response to an air/fuel ratio leaner than a desired air/fuel ratio. Further still, the method may comprise storing gaseous fuel in a purge canister fluidly coupled to the PCV system and the gaseous fuel source. The method may further comprise directing gaseous fuel from the purge canister to the PCV system responsive to the blow-by flow rate being less than the PCV valve flow rate, and a purge canister pressure being greater than a PCV air inlet line pressure. Further still, the method may comprise in response to a deceleration fuel shut off event, determining an excess gaseous fuel amount delivered to the PCV system, and lowering the flow rate of the gaseous fuel by an amount corresponding to the excess gaseous fuel amount. Further still, the method may comprise storing the excess gaseous fuel amount in a purge canister fluidly coupled to the PCV system.

Figure 5:
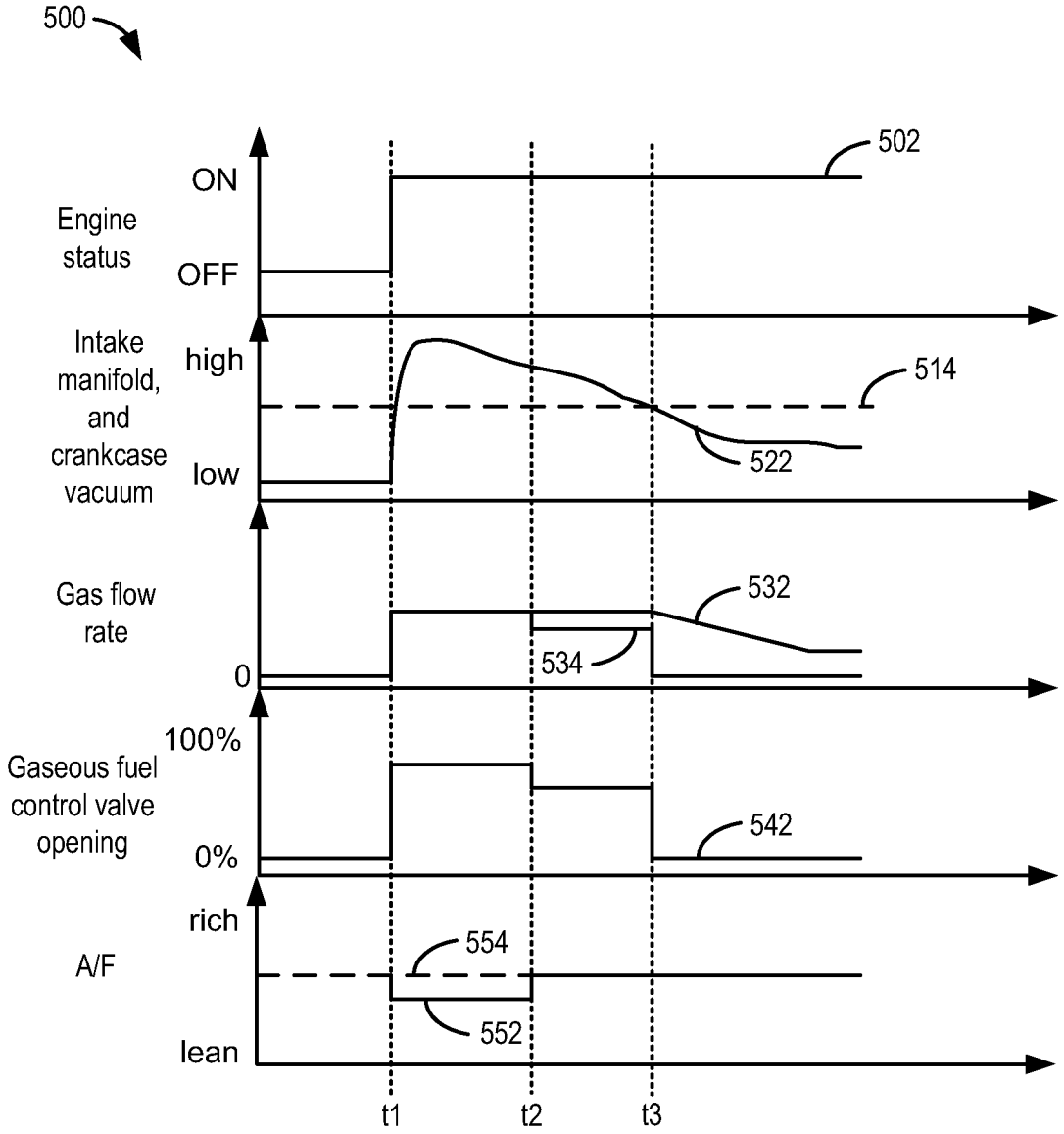
FIG. 5 illustrates an example timeline for a vehicle system.

Turning now to FIG. 5, it illustrates an example timeline 500 for operating a vehicle system. Timeline 500 includes trend lines for engine status 502, intake manifold vacuum 522, gas flow rates $Q_{PCVV}-Q_{B-B}$ 532 and $Q_{gasfuel}$ 534, gaseous fuel flow control valve opening 542, and A/F 552. Also shown are trend lines for crankcase vacuum 514 and $A/F_{desired}$ 554.

Prior to time t1, the engine status 502 is OFF, the intake manifold vacuum 522 is below crankcase vacuum 514, the gaseous fuel flow control valve opening 542 is 0% (e.g., closed), and $Q_{PCVV}$, $Q_{B-B}$, $Q_{PCVV}-Q_{B-B}$ 532, and $Q_{gasfuel}$ 534 are all zero. At t1, the engine status changes from OFF to ON, the intake manifold vacuum 522 rises above crankcase vacuum 514, and $Q_{PCVV}-Q_{B-B}$ 532 is greater than zero (e.g., $Q_{PCVV}>Q_{B-B}$), and a first condition is thereby satisfied. Accordingly, the control system 190 opens the gaseous fuel flow control valve 151 and sets the gaseous fuel flow control valve opening 542 such that $Q_{gasfuel}$ 534 is equivalent to $Q_{PCVV}-Q_{B-B}$ 532 between t1 and t2. Thus gaseous fuel, for example methane gas, is delivered to the PCV system 116 in order to help reduce friction losses in the engine crankcase while cooling the engine. Furthermore, the gaseous fuel may be delivered to the PCV system 116 at a flow rate that makes up the difference between the $Q_{PCVV}$ and $Q_{B-B}$. Further still, the gaseous fuel may be delivered to an air inflow line such as crankcase ventilation tube 74 of PCV system 116 via a gaseous fuel flow control valve 151.

After t1 and prior to t2, A/F 552 is determined to be less than $A/F_{desired}$ 554. A/F may be less than $A/F_{desired}$ because calculated $Q_{B-B}$ may be less than the actual blow-by flow rate. Furthermore, between t1 and t2, a first condition remains satisfied since the intake manifold vacuum 22 is greater than the crankcase vacuum 514, the engine status 502 is ON, and $Q_{PCVV}-Q_{B-B}$ is greater than zero. Accordingly, at t2, $Q_{gasfuel}$ 534 is adjusted lower in response to A/F being less than $A/F_{desired}$.

At t3, the intake manifold vacuum 522 becomes less than the crankcase vacuum 514. As such, the first condition is no longer satisfied, and control system 190 closes the gaseous fuel control valve opening 542, thereby stopping delivery of gaseous fuel to the PCV system 116. When the intake manifold vacuum 522 becomes less than the crankcase vacuum 514, air and gaseous fuel delivered to crankcase ventilation tube 74 may not be adequately fed to crankcase 28.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A vehicle system, comprising:

an internal combustion engine including a crankcase;

a first conduit coupling the crankcase with a fresh air intake upstream of a compressor and an intake throttle;

a second conduit coupling a fuel tank containing compressed natural gas with the first conduit and having a flow control valve arranged therein;

a third conduit coupling the crankcase with the intake downstream of the throttle; and a controller having executable instructions to control the flow control valve to deliver compressed natural gas from the fuel tank to the first conduit via the second conduit and then into the crankcase.

2. The vehicle system of claim 1, further comprising a purge canister fluidly couplable to the second conduit depending on a state of a first three-way valve arranged in the second conduit downstream of the flow control valve.

3. The vehicle system of claim 2, further comprising a fourth conduit coupling the fuel tank with the engine, wherein the purge canister is further fluidly couplable to the fourth conduit depending on a state of a second three-way valve arranged in the fourth conduit.

4. The vehicle system of claim 1, wherein the compressed natural gas comprises methane.

5. The vehicle system of claim 1, wherein a viscosity of the compressed natural gas is lower than a viscosity of air.

6. A method, comprising:

delivering compressed natural gas to a first conduit of a PCV system of an engine via a second conduit, and then from the first conduit into an engine crankcase, the second conduit coupling a fuel tank containing the compressed natural gas with the first conduit, the first conduit coupling the crankcase with a fresh air intake upstream of a throttle, in response to a blow-by gas flow rate being less than a flow rate of a PCV valve arranged in a third conduit, the third conduit coupling the crankcase with the intake downstream of the throttle.

7. The method of claim 6, further comprising:

initiating the delivery of compressed natural gas to the first conduit via the second conduit in response to the blow-by gas flow rate falling below the PCV valve flow rate only while a manifold vacuum is greater than a crankcase vacuum, the crankcase vacuum increasing with an increasing engine speed.

8. The method of claim 6, wherein the compressed natural gas is delivered at a flow rate of a difference between the PCV valve flow rate and the blow-by gas flow rate.

9. The method of claim 8, further comprising lowering the flow rate of the compressed natural gas in response to an air/fuel ratio leaner than a desired air/fuel ratio.

10. The method of claim 9, further comprising storing compressed natural gas in a purge canister, the purge canister fluidly couplable with the second conduit depending on a state of a first three-way valve, the purge canister further fluidly couplable with a fourth conduit depending on a state of a second three-way valve, the fourth conduit coupling the fuel tank with the engine.

11. The method of claim 10, further comprising directing compressed natural gas from the purge canister to the PCV system responsive to the blow-by gas flow rate being less than the PCV valve flow rate, and a purge canister pressure being greater than a PCV air inlet line pressure.

12. The method of claim 8, further comprising in response to a deceleration fuel shut off event, determining an excess amount of compressed natural gas delivered to the crankcase, and lowering the flow rate of the compressed natural gas by an amount corresponding to the excess amount of compressed natural gas.

13. The method of claim 12, further comprising storing the excess amount of compressed natural gas in a purge canister fluidly coupled to the PCV system.

14. The method of claim 6, further comprising stopping the delivery of compressed natural gas to the crankcase when the engine is stopped.

15. The method of claim 6, further comprising stopping the delivery of compressed natural gas to the crankcase when a manifold vacuum is below a crankcase vacuum.

16. A vehicle, comprising:

an internal combustion engine including a crankcase and a PCV system;

a first conduit coupling the crankcase with a fresh air intake upstream of a compressor and an intake throttle;

a second conduit coupling a fuel tank containing compressed natural gas with the first conduit and having a flow control valve arranged therein;

a third conduit coupling the crankcase with the intake downstream of the throttle and having a PCV valve arranged therein; and a controller having executable instructions to deliver compressed natural gas from the second conduit to the first conduit and then into the crankcase responsive to a blow-by gas flow rate being less than a flow rate of the PCV valve and a manifold vacuum being greater than a crankcase vacuum.

17. The vehicle of claim 16, wherein the flow control valve is configured to deliver the compressed natural gas from the second conduit to the first conduit and then into the crankcase at a flow rate of a difference between the PCV valve flow rate and the blow-by gas flow rate.

18. The vehicle of claim 16, wherein the executable instructions further comprise instructions to close the flow control valve in response to the manifold vacuum dropping below the crankcase vacuum.

19. The vehicle of claim 16, wherein the vehicle further comprises an additional fuel tank containing a liquid fuel.

* * * * *